US008174549B2

(12) United States Patent
Murakami

(10) Patent No.: US 8,174,549 B2
(45) **Date of Patent: *May 8, 2012**

(54) IMAGE FORMING APPARATUS, SURFACE PROPERTY REFORMING SHEET, AND METHOD FOR FORMING IMAGE

(75) Inventor: Takaaki Murakami, Kanagawa (JP)

(73) Assignee: Sony Corporation, Tokyo (JP)

( * ) Notice: Subject to any disclaimer, the term of this patent is extended or adjusted under 35 U.S.C. 154(b) by 480 days.

This patent is subject to a terminal disclaimer.

(21) Appl. No.: 12/406,443

(22) Filed: Mar. 18, 2009

(65) Prior Publication Data

US 2009/0256899 A1 Oct. 15, 2009

(30) Foreign Application Priority Data

Apr. 10, 2008 (JP) ..... 2008-102037

(51) Int. Cl.
*B41J 2/325* (2006.01)

(52) U.S. Cl. ... 347/175; 347/171; 347/212; 400/123.03; 400/196

(58) Field of Classification Search ..... 347/171–176, 347/212–214; 400/120.01–120.04, 194, 400/196
See application file for complete search history.

(56) References Cited

U.S. PATENT DOCUMENTS

| | | | | |
|---|---|---|---|---|
| 4,666,320 | A * | 5/1987 | Kobayashi et al. | 400/241.1 |
| 5,116,148 | A * | 5/1992 | Ohara et al. | 400/241 |
| 5,965,485 | A * | 10/1999 | Mizumachi et al. | 503/227 |
| 5,978,005 | A * | 11/1999 | Hadley | 347/177 |
| 6,092,942 | A * | 7/2000 | Koichi et al. | 400/120.02 |
| 2007/0182807 | A1 * | 8/2007 | Sawada et al. | 347/213 |

FOREIGN PATENT DOCUMENTS

| | | |
|---|---|---|
| JP | 2004-279568 | 10/2004 |
| JP | 2005-219388 | 8/2005 |

* cited by examiner

*Primary Examiner* — Julian Huffman
*Assistant Examiner* — Sharon A Polk
(74) *Attorney, Agent, or Firm* — SNR Denton US LLP

(57) ABSTRACT

An image forming apparatus includes a feeding device feeding a recording medium to be recorded, a thermal transfer sheet having an ink layer to form an image and a protective material layer to form a protective layer protecting the image, a thermal transfer sheet transporting device, a surface property reforming sheet having an image printing opening disposed in such a way that the thermal transfer sheet comes into direct contact with a surface of the recording medium to be recorded and a surface property reforming portion to reform the surface state of the protective layer protecting the image, a reforming sheet moving device, and a thermal head to thermally transfer the ink layer or the protective material layer, wherein a non-adhesion treatment layer is formed on at least a surface of the surface property reforming sheet on the side to come into contact with the thermal transfer sheet.

13 Claims, 6 Drawing Sheets

IMAGE FORMING APPARATUS, SURFACE PROPERTY REFORMING SHEET, AND METHOD FOR FORMING IMAGE

BACKGROUND OF THE INVENTION

1. Field of the Invention

The present invention relates to an image forming apparatus, a surface property reforming sheet, and a method for forming an image.

2. Description of the Related Art

In related art at present, leading examples of thermal line printers include sublimation type, fusion type, and heat sensitive type printers.

In thermal heads used in the above-described printers, a plurality of heater elements (resistance elements) are arranged in a line. The plurality of heater elements are energized selectively in accordance with levels of gray scale, and image printing is conducted on various types of recording sheet through the use of the thermal energy generated at that time.

Regarding the sublimation type, image printing is conducted by holding an ink ribbon and a recording sheet fed to a platen with a thermal head, energizing and driving heater elements in the thermal head selectively, and sublimating an ink on the ink ribbon so as to transfer the ink to the recording sheet. In general, the above-described ink ribbon is wound around a supply reel and a take-up reel and has a configuration in which ink layers of a plurality of different colors and a protective material layer (L) are sequentially repeatedly formed on a base film along the feeding direction of the ink ribbon. The above-described ink layers includes, for example, ink layers of each of yellow (Y), magenta (M), and cyan (C).

The above-described protective material layer protects an image produced by the above-described ink layers transferred to the recording sheet, and it is possible to form a transparent film layer on the above-described image through thermal transfer so as to improve the chemical agent and solvent resistance, the oil and grease resistance, the friction resistance, and the like. Furthermore, it is also possible to enhance the surface glossiness of the image and improve the quality.

Moreover, frosted or matte expression is also possible by controlling energy applied to the thermal head at a stage of transfer of the protective material layer or conducting transfer on the basis of a specific pattern. In this manner, the surface property can be selected to meet the preferences of the user.

However, the above-described protective material layer is peeled off a release layer which has been formed on a base film of a thermal transfer sheet and which exhibits insufficient smoothness and is transferred in such a way that the peeling surface thereof becomes a surface of an image print. Consequently, the level of glossiness is lower than that of a silver halide photograph.

Regarding this issue, surface property reforming technologies have been disclosed, in which desired surface properties including the above-described improved surface glossiness can be provided to image prints.

In one of the surface property reforming technologies (first related art), distribution of glossiness is provided to a surface of a sheet member in accordance with the image information (the brightness, the density of image, the color tone of image, the size of image, and combinations thereof) and, thereby, a three-dimensional appearance is given to an image print.

It is described that an uneven shape of a sheet member can be controlled by combining an image heating device and surface properties of a plurality of contact members and, as a result, desired distribution of the glossiness can be provided on a sheet member surface. It is described that when the surface of the contact member (endless belt) is a mirror-finished surface, the glossiness of the heated portion is improved and the glossiness of the other portion remains at a normal level and, therefore, a three-dimensional appearance can be given to the image (refer to, for example, Japanese Unexamined Patent Application Publication No. 2005-219388).

Furthermore, in one of the above-described technologies (second related art), a configuration is disclosed, in which a sheet member heating device for transferring surface properties of a contact member to a sheet member heated in a sheet member preheating portion and a sheet member cooling device for cooling the above-described sheet member while the sheet member is in contact with the above-described contact member are included.

In this technology, an endless belt is adopted as the above-described contact member, and the surface thereof is finished to have desired surface properties (one of a glossy surface, a matte surface, and an embossed surface). It is described that a record image on hand can easily be converted to an image having desired surface glossiness (high gloss, medium gloss, matte, and the like) in this manner (refer to, for example, Japanese Unexamined Patent Application Publication No. 2004-279568).

Moreover, one of the above-described technologies (third related art) has a configuration in which a pressure and heat treatment is conducted while a recording sheet, a surface property reforming sheet, and an ink ribbon are sandwiched in such a way as to be stacked sequentially at a position of image printing. This technology is devised in such a way that an opening portion is provided in a part of the above-described surface property reforming sheet and is used when pressure and heat are applied to the ink ribbon.

That is, in the case where image printing and a lamination (formation of a protective layer) treatment are conducted, the above-described opening portion is aligned in such a way as to face a thermal head and, thereby, a thermal transfer sheet is allowed to come into direct contact with the recording sheet. In the case where a surface state of the transferred protective material layer is reformed, it is favorable that a desired portion of the above-described surface property reforming sheet is used and the pressure and heat treatment is conducted by using the same thermal head while the ink ribbon is interposed. At that time, if the thermal transfer sheet is aligned with a used part of the protective material layer, the time taken for feeding (taking up) the thermal transfer sheet becomes minimum, so that setting can be completed speedily. Furthermore, since the above-described protective material layer is wholly transferred to the recording sheet, the used part thereof is in a state of being consumed uniformly and, therefore, it is favorable.

This technology has a simple configuration as compared with other technologies because the pressure and heat treatment with respect to the ink ribbon and the pressure and heat treatment with respect to the surface property reforming sheet can be conducted with the same thermal head. Along with that, miniaturization, cost reduction, and the like of the apparatus can also be expected.

In the above-described third related art, apprehension remains about the timing of the surface property reforming treatment. In this timing, as described above, the used part of the protective material layer (or ink layer) and the surface property reforming sheet are subjected to the pressure and heat treatment while they are stacked on top of each other.

Regarding the above-described used part, most of the protective material layer is peeled off the base film through transfer. Consequently, a release layer thereunder is in the state of being exposed in a wide range. The range of formation of the protective material layer is originally a region slightly larger than the sheet size applied. Therefore, strictly, as shown in FIG. 6, an unreleased portion 39 indicated as a diagonally shaded portion remains in the marginal portion of the protective material layer 35 of the thermal transfer sheet 30 in any way, while the marginal portion is a used part, but is not included in the transfer range.

In addition, in the case where the above-described surface property reforming treatment is conducted in the state in which the unreleased portion 39 of the above-described protective material layer 35 remains, the unreleased portion 39 of the above-described protective material layer 35 may be transferred to the surface property reforming sheet so as to cause inconveniences.

More specifically, the surface property reforming sheet and the thermal transfer sheet may be adhered through the pressure and heat treatment in the unreleased portion of the protective material layer so as to cause defective peeling after the surface property reforming treatment.

Furthermore, the unreleased portion of the protective material layer, which is adhered to the surface property reforming sheet side through transfer, may be accumulated by repetition of the treatment, so that an application of a uniform pressure and heat treatment to the recording sheet becomes difficult.

Because of these inconveniences, for example, desired glossiness may not be obtained, and there may be variations in a matte state. Therefore, the surface property reforming treatment may become defective and there is apprehension about the long term stability.

On the other hand, if the surface property reforming sheet is formed from a polyimide film (for example, UPILEX: produced by UBE INDUSTRIES, LTD.) exhibiting low adhesion to other substances, even when the protective material layer becomes into a state of being softened to some extent and coming into intimate contact in the surface property reforming treatment, it is possible to allow an occurrence of the transfer to become difficult.

However, the situation is different from the unreleased portion, which remains on the ink ribbon, of the laminating layer also serving as a protective material.

In general, in order to obtain stable property of lamination on the recording sheet after the image is formed, the laminating layer configured to have at least two layers is used. That is, regarding an uppermost layer (L3 layer) relative to the base film, a material exhibiting excellent adhesion to the recording sheet is used in forming (laminating) a protective layer, and a material which is easily peeled off a release layer is used for a lowermost layer (L2 layer) in contact with the release layer. Consequently, it is made possible to form a stable protective material layer on an image formation surface of the recording sheet and obtain a state excellent in releasability from the thermal transfer sheet.

The protective material layer with which the polyimide film comes into contact in the surface property reforming treatment of an image print is the L2 layer, and this layer and the polyimide are difficult to adhere to each other. However, a layer, which comes into contact with the polyimide film, of the unreleased portion of the protective material layer remaining on the thermal transfer sheet side is the L3 layer exhibiting excellent adhesion. Therefore, use of polyimide exhibiting low adhesion is not satisfactory because transfer to the surface property reforming sheet may occur under the influence of variations in the ambient environment, repetition of the treatment, and the like.

SUMMARY OF THE INVENTION

The present inventors have recognized that in the case where a protective material layer formed on a thermal transfer sheet is thermally transferred to a recording medium to be recorded and, thereafter, a surface property reforming treatment is conducted while the thermal transfer sheet includes an unreleased portion of the protective material layer, the above-described unreleased portion of the protective material layer is transferred to a surface property reforming sheet. More specifically, the surface property reforming sheet and the thermal transfer sheet are adhered to each other at the unreleased portion of the protective material layer through a pressure and heat treatment, so as to cause defective peeling after the surface property reforming treatment.

It is desirable that in the case where a surface property reforming treatment of a surface of a protective layer formed on a recording medium to be recorded is conducted by using a surface property reforming sheet, adhesion of the surface property reforming sheet and a thermal transfer sheet at an unreleased portion of the protective material layer is prevented so as to facilitate peeling of the surface property reforming sheet and the thermal transfer sheet after the surface property reforming treatment.

An image forming apparatus according to an embodiment of the present invention includes feeding means for feeding a recording medium to be recorded in a predetermined direction, a thermal transfer sheet having an ink layer to form an image through thermal transfer on a surface of the above-described recording medium to be recorded and a protective material layer to form a protective layer protecting the image through thermal transfer, a thermal transfer sheet transporting means for transporting the thermal transfer sheet, a surface property reforming sheet having an image printing opening disposed in such a way that the above-described thermal transfer sheet comes into direct contact with a surface of the above-described recording medium to be recorded and a surface property reforming portion to reform the surface state of the protective layer protecting the image formed on the above-described recording medium to be recorded, a reforming sheet moving means for moving the above-described surface property reforming sheet, and a thermal head to thermally transfer the ink layer or the protective material layer of the above-described thermal transfer sheet to a surface of the above-described recording medium to be recorded, wherein a non-adhesion treatment layer is formed on at least a surface of the above-described surface property reforming sheet on the side to come into contact with the above-described thermal transfer sheet.

In the image forming apparatus according to an embodiment of the present invention, the non-adhesion treatment layer is formed on at least a surface of the surface property reforming sheet on the side to come into contact with the thermal transfer sheet. Consequently, in the surface property reforming treatment of the protective layer, even when a used part of the protective material layer (or ink layer) formed on the thermal transfer sheet and the surface property reforming sheet are stacked and subjected to a pressure and heat treatment, adhesion does not occur easily. Therefore, transfer of an unreleased portion in the used part of the thermal transfer sheet to a backside of the surface property reforming sheet can be prevented. That is, an occurrence of defective peeling after the surface property reforming treatment due to adhesion of the surface property reforming sheet and the thermal transfer sheet can be prevented and, in addition, accumulation of the unreleased portion adhered to the surface property reforming sheet side can be prevented.

The surface property reforming sheet according to an embodiment of the present invention has the image printing opening to allow the thermal transfer sheet, which is configured to form an image and a protective layer protecting the image through thermal transfer on a surface of the recording medium to be recorded, to comes into direct contact with the surface of the recording medium to be recorded and the surface property reforming portion to reform the surface of the protective layer protecting the image formed on the above-described recording medium to be recorded, and the non-adhesion treatment layer is formed on at least a surface on the side to come into contact with the thermal transfer sheet.

Regarding the surface property reforming sheet according to an embodiment of the present invention, the non-adhesion treatment layer is formed on at least a surface of the surface property reforming sheet on the side to come into contact with the thermal transfer sheet. Consequently, in the surface property reforming treatment of the protective layer, even when a used part of the protective material layer (or ink layer) formed on the thermal transfer sheet and the surface property reforming sheet are stacked and subjected to a pressure and heat treatment, adhesion does not occur easily. Therefore, transfer of an unreleased portion in the used part of the thermal transfer sheet to a backside of the surface property reforming sheet can be prevented. That is, an occurrence of defective peeling after the surface property reforming treatment due to adhesion of the surface property reforming sheet and the thermal transfer sheet can be prevented and, in addition, accumulation of the unreleased portion adhered to the surface property reforming sheet side can be prevented.

The method for forming an image according to an embodiment of the present invention includes the steps of sandwiching a surface property reforming sheet having an image printing opening disposed in such a way that a thermal transfer sheet comes into direct contact with a surface of a recording medium to be recorded and a surface property reforming portion to reform the surface state of a protective layer protecting an image formed on the above-described recording medium to be recorded between the above-described recording medium to be recorded and the above-described thermal transfer sheet having an ink layer to form an image through thermal transfer on a surface of the above-described recording medium to be recorded and a protective material layer to form a protective layer protecting the image through thermal transfer, transporting the above-described recording medium to be recorded, the above-described surface property reforming sheet, and the above-described thermal transfer sheet in a predetermined direction, forming the image by thermally transferring the above-described ink layer to the above-described recording medium to be recorded while the above-described ink layer of the thermal transfer sheet and an image formation position of the above-described recording medium to be recorded are aligned with the above-described image printing opening, forming the protective layer by thermally transferring the above-described protective material layer to the recording medium to be recorded while the above-described protective material layer of the above-described thermal transfer sheet and the position of the image formed on the above-described recording medium to be recorded are aligned with the above-described image printing opening, and reforming the surface of the above-described protective layer while the above-described surface property reforming portion is pressed against the above-described protective layer from the above-described thermal transfer sheet side and heating is conducted, wherein a non-adhesion treatment layer is formed on at least a surface of the above-described surface property reforming sheet on the side to come into contact with the above-described thermal transfer sheet side.

In the method for forming an image according to an embodiment of the present invention, the non-adhesion treatment layer is formed on at least a surface of the surface property reforming sheet on the side to come into contact with the thermal transfer sheet. In the case where this non-adhesion treatment layer is formed, in the surface property reforming treatment of the protective layer, even when a used part of the protective material layer (or ink layer) of the thermal transfer sheet and the surface property reforming sheet are stacked and subjected to a pressure and heat treatment, adhesion does not occur easily. Therefore, transfer of an unreleased portion in the used part of the thermal transfer sheet to a backside of the surface property reforming sheet can be prevented. That is, an occurrence of defective peeling after the surface property reforming treatment due to adhesion of the surface property reforming sheet and the thermal transfer sheet can be prevented and, in addition, accumulation of the unreleased portion adhered to the surface property reforming sheet side can be prevented.

According to the image forming apparatus of an embodiment of the present invention, adhesion between the surface property reforming sheet and the thermal transfer sheet can be prevented. Therefore, there is an advantage that the surface property reforming sheet can be peeled off the thermal transfer sheet easily after the surface property reforming treatment. Furthermore, since accumulation of the unreleased portion adhered to the surface property reforming sheet side is prevented, there is an advantage that the surface of the protective layer can be reformed into a desired surface state (glossiness, silky or matte finish, and the like) with good quality. Moreover, the surface property reforming treatment can be conducted repeatedly and, thereby, insufficiency in durability is eliminated.

According to the surface property reforming sheet of an embodiment of the present invention, adhesion between the surface property reforming sheet and the thermal transfer sheet can be prevented. Therefore, there is an advantage that the surface property reforming sheet can be peeled off the thermal transfer sheet easily after the surface property reforming treatment. Furthermore, since accumulation of the unreleased portion adhered to the surface property reforming sheet side is prevented, there is an advantage that the surface of the protective layer can be reformed into a desired surface state (glossiness, silky or matte finish, and the like) with good quality. Moreover, the surface property reforming treatment can be conducted repeatedly and, thereby, insufficiency in durability is eliminated.

According to the method for forming an image of an embodiment of the present invention, adhesion between the surface property reforming sheet and the thermal transfer sheet can be prevented. Therefore, there is an advantage that the surface property reforming sheet can be peeled off the thermal transfer sheet easily after the surface property reforming treatment. Furthermore, since accumulation of the unreleased portion adhered to the surface property reforming sheet side is prevented, there is an advantage that the surface of the protective layer can be reformed into a desired surface state (glossiness, silky or matte finish, and the like) with good quality. Moreover, the surface property reforming treatment can be conducted repeatedly and, thereby, insufficiency in durability is eliminated.

DESCRIPTION OF THE PREFERRED EMBODIMENTS

Figure 1:
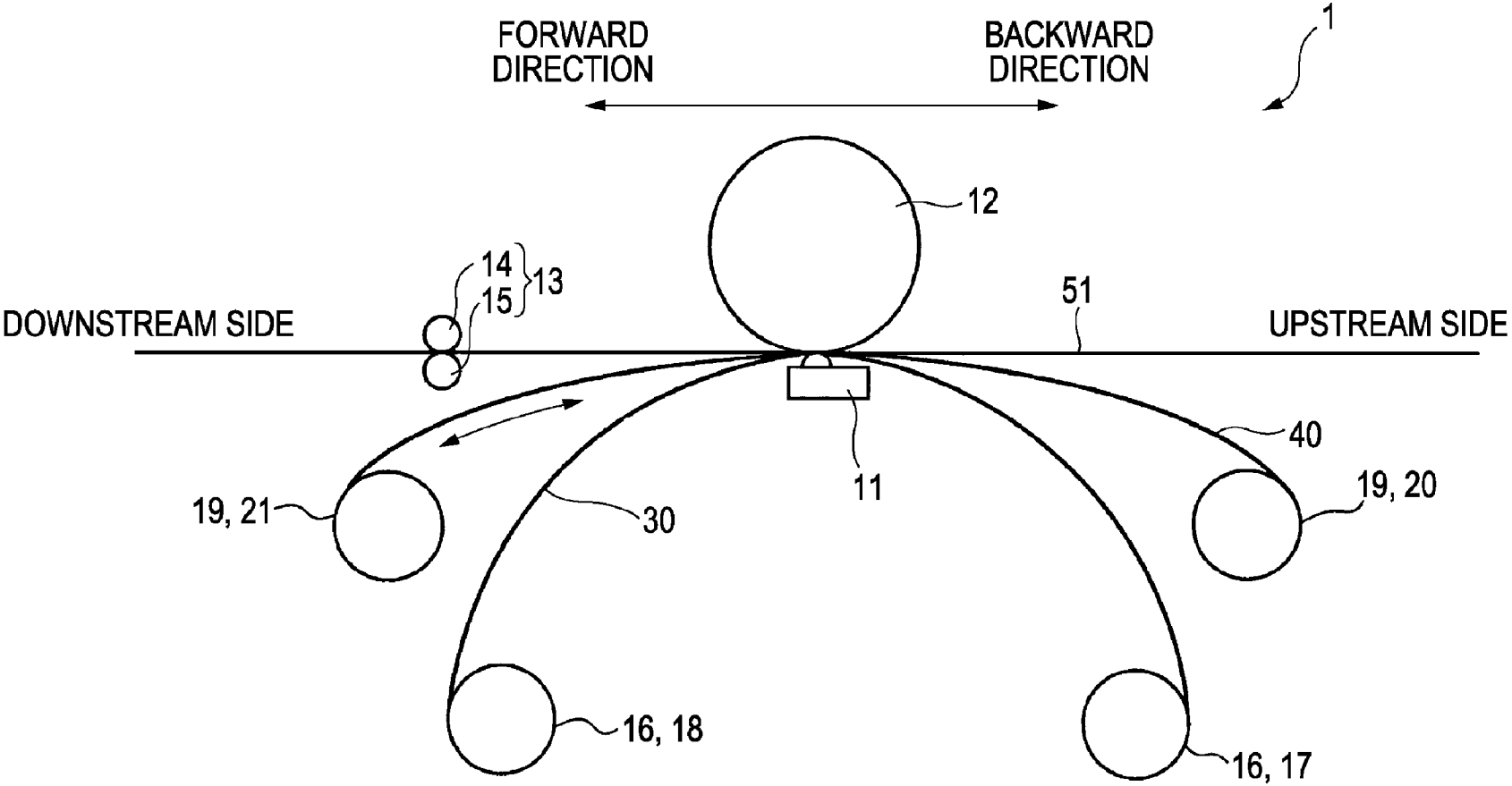
FIG. 1 is a schematic configuration diagram of a key portion of an image forming apparatus according to an embodiment of the present invention.
Figure 2A:
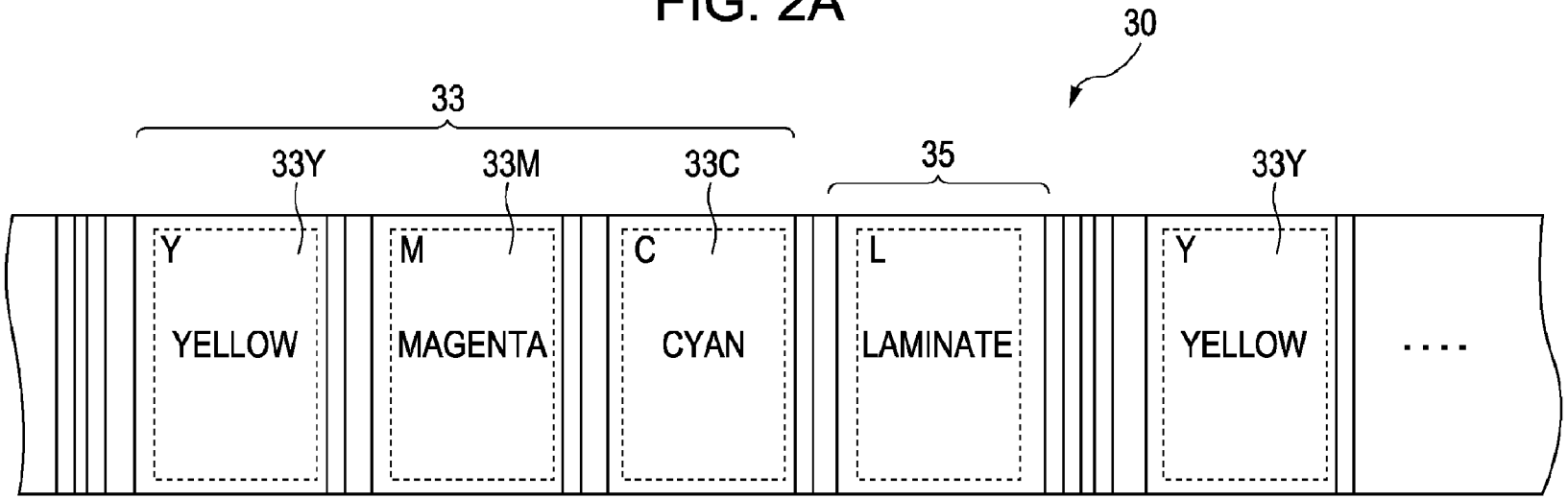
FIGS. 2A and 2B are a plan view and a sectional view, respectively, of an ink ribbon according to an embodiment of the present invention.
Figure 2B:
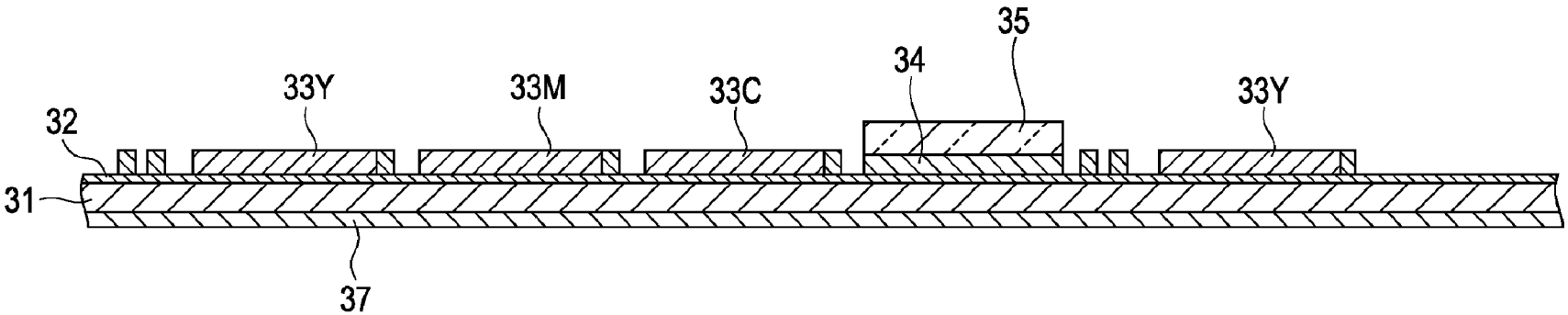

An example of an embodiment according to the present invention will be described with reference to a schematic configuration diagram of a key portion of an image forming apparatus, as shown in FIG. 1, and a plan view and a sectional view of an ink ribbon, as shown in FIGS. 2A and 2B. FIG. 1 shows a sublimation thermal printer as an example of an image forming apparatus.

As shown in FIG. 1 and FIG. 2, the key portion of an image forming apparatus 1 includes a thermal head 11 for thermally transferring an ink layer 33 or a protective material layer 35 of a thermal transfer sheet 30 to a surface of a recording medium to be recorded 51. In general, the above-described thermal transfer sheet 30 is also referred to as an ink ribbon. The explanations hereafter will be made on the assumption that it is an ink ribbon. Furthermore, for example, a recording sheet is used as the recording medium to be recorded 51. The explanations hereafter will be made on the assumption that it is a recording sheet.

The above-described thermal head 11 thermally transfers the ink layer 33 formed on the ink ribbon 30 to the recording sheet 51 through the use of heat generation energy when a heater element (not shown in the drawing) disposed therein is energized, so that an image is formed. Furthermore, the protective material layer 35 formed on the ink ribbon 30 is thermally transferred to the image, so that a protective layer (not shown in the drawing) is formed.

The recording sheet 51 in the shape of a roll is set in a predetermined place and is pulled out therefrom and fed, as necessary. The pulled-out recording sheet 51 is guided by a sheet feeding path and runs on a platen roller 12 which is disposed facing the above-described thermal head 11 and which conducts printing of an image. After printing of the image is completed, the recording sheet 51 is cut into a predetermined length with a cutter disposed on the downstream side and is discharged through a paper outlet.

That is, the above-described recording sheet 51 is held between, for example, a pinch roller 14 and a capstan 15, which serve as a feeding device 13, and is fed forward or backward on the basis of their normal or reverse rotation drive.

Regarding the above-described drawings, explanations are made on the assumption that the above-described recording medium (recording sheet) 51 is rolled paper. However, the recording sheet 51 is not limited to the rolled paper and may be a recording sheet in an unrolled form, for example, cut sheet paper. Regarding an image forming apparatus by using the unrolled paper, e.g., cut sheet paper, cutting of the recording medium to be recorded (recording sheet) 51 is unnecessary and, therefore, the above-described cutter is not disposed.

On the other hand, the ink ribbon 30 is fed to the platen roller 12 with a thermal transfer sheet transporting device 16. Specifically, the ink ribbon 30 pulled out of a feed reel 17 is guided by individual rollers (not shown in the drawing) and runs on the platen roller 12 which conducts printing of an image so as to be fed to a take-up reel 18 successively. The thermal transfer sheet transporting device 16 is configured to include them.

Here, the above-described ink ribbon 30 will be described in detail with reference to the plan view and the sectional view shown in FIGS. 2A and 2B, respectively.

As shown in FIGS. 2A and 2B, the above-described ink ribbon 30 has a configuration in which ink layers 33 (33Y), 33 (33M), and 33 (33C) of yellow (Y), magenta (M), and cyan (C) and, furthermore, a transparent protective material layer 35 (L) disposed on a release layer 34 are sequentially periodically formed on a base film 31 with an easy-to-adhere layer 32 therebetween along a feeding direction thereof. Each ink layer 33 is formed from, for example, a sublimation dye.

The above-described protective material layer 35 (L) is disposed following the above-described ink layers 33Y, 33M, and 33C. This protective material layer 35 (L) is formed by applying, for example, a transparent laminating resin. The above-described protective material layer 35 (L) is thermally transferred following the image formation through transfer of the above-described ink layer 33 to the recording sheet and serves as a protective layer of the image. Consequently, the chemical agent and solvent resistance, the oil and grease resistance, the abrasion resistance, and the like can be improved.

The surface glossiness of the image can be enhanced and the image quality can also be improved by conducting this protective layer formation treatment (lamination treatment).

Furthermore, a heat-resistant lubricating layer 37 is formed on the backside of the above-described base film 31 mainly for the purpose of, for example, reducing friction between the thermal head and the ink ribbon so as to facilitate stable transportation of the ink ribbon during the image printing and the surface property reforming treatment.

Regarding the above-described ink ribbon 30, the easy-to-adhere layer 32 is formed on the base film 31 side of the protective material layer (layer for forming the protective layer) 35 (L), and the release layer 34 is formed on this easy-to-adhere layer 32. Therefore, transferability in the thermal transfer to the recording sheet (refer to FIG. 1) is improved. That is, in the transfer to the recording sheet, peeling occurs at the interface between the above-described release layer 34 and the protective material layer 35 (L), the release layer 34 remains on the ink ribbon 30 side, and merely the protective material layer 35 (L) is thermally transferred to the recording sheet so as to protect the image recorded on the recording sheet.

The image forming apparatus 1 includes a surface property reforming sheet 40 interposed between the above-described recording sheet 51 and the ink ribbon 30, as shown in FIG. 1. The surface property reforming sheet 40 reforms the surface state of the image print covered with the protective layer.

Figure 3A:
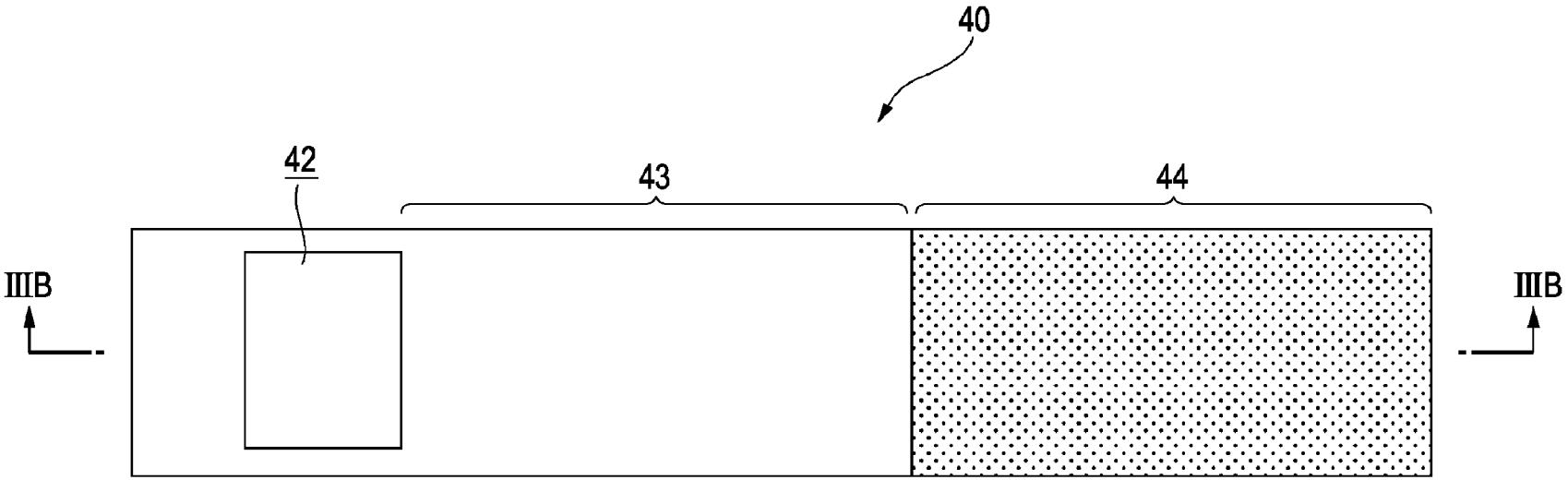
FIGS. 3A and 3B are a plan view and a sectional view, respectively, of a surface property reforming sheet according to an embodiment of the present invention.
Figure 3B:
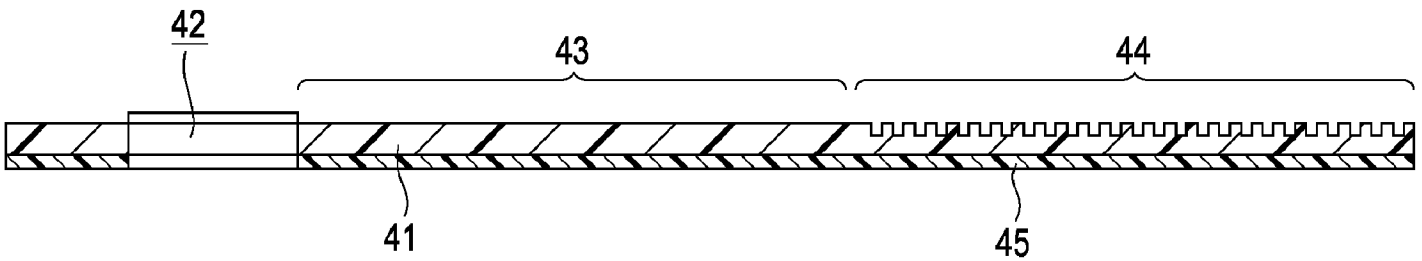

For example, as indicated by a plan view shown in FIG. 3A and a sectional view shown in FIG. 3B, an image printing opening 42 is disposed in a ribbon-shaped base material sheet 41 in such a way that the above-described ink ribbon 30 (refer to FIG. 1 and FIGS. 2A and 2B) comes into direct contact with a surface of the recording sheet 51 (refer to FIG. 1). Furthermore, surface property reforming portions 43 and 44 for reforming the surface state of the protective layer protecting the image formed on the recording sheet 51 are formed side by side in a longitudinal direction of the base material sheet 41.

The above-described base material sheet 41 is formed from, for example, a polyimide film. As a matter of course, the base material sheet 41 may be formed from other types of resin film.

A non-adhesion treatment layer 45 is formed on at least a surface of the surface property reforming sheet 40 on the side to come into contact with the above-described ink ribbon 30. This non-adhesion treatment layer 45 will be described later in detail.

As shown in FIG. 1, the surface property reforming sheet 40 is fed between the ink ribbon 30 and the recording sheet 51 with a reforming sheet moving device 19. This reforming sheet moving device 19 is composed of, for example, dedicated feed reel 20 and take-up reel 21, in a manner similar to that for the above-described ink ribbon 30.

The above-described surface property reforming sheet 40 is stretched between the feed reel 20 and the take-up reel 21 and is moved forward or backward by driving them. In addition, attachment to and detachment from an apparatus can also be conducted.

Regarding the above-described image forming apparatus 1, in the image printing, the above-described thermal head 11 is moved to an image printing position, and the recording sheet 51 is held between the thermal head 11 and the ink ribbon 30 so as to become into the state of being pressed into contact with the platen roller 12.

At that time, the above-described surface property reforming sheet 40 is aligned in such a way that the image printing opening 42 thereof comes just above the thermal head 11.

That is, the above-described thermal head 11 can come into direct contact with the ink ribbon 30 through the above-described image printing opening 42, and pressurization and heating can be conducted.

When image printing data are input, heater elements in the thermal head 11 are selectively energized and driven every feeding of the recording sheet 51, and the ink on the ink ribbon 30 is sublimated and transferred to the recording sheet 51, so that an image is formed.

In the case where color image is printed, image printing is conducted on a ink color basis. Therefore, every time the ink ribbon 30 is fed and the transfer color is changed, the pinch roller and the capstan 15 are rotated in a reverse direction and the recording sheet is fed backward so as to return to an image printing start position. When transfer of individual ink colors is completed, the ink ribbon 30 is fed successively, and transfer of the protective material layer 35 is conducted.

In the above-described image forming apparatus 1, after the image printing and the treatment for forming the protective layer, a surface property reforming treatment of a surface of the above-described protective layer can be conducted.

The surface glossiness of the image can be enhanced by forming the protective layer. However, strictly, the protective layer is peeled off the release layer 34 which is formed on the base film 31 of the ink ribbon 30 and which exhibits insufficient smoothness, and transfer is conducted in such a way that the peeled surface becomes a surface of the image print (protective layer). Consequently, the glossiness is not yet at a satisfactory level.

Then, the glossiness comparable to that of a silver halide photograph can be obtained by conducting the surface property reforming treatment. In the surface property reforming treatment conducted here, a heat treatment is conducted while the surface property reforming sheet 40 having a desired surface properties is pressed against the recording sheet 51 subjected to the treatment for forming the above-described protective layer and, thereby, the surface properties of the surface property reforming portion 43 or the surface property reforming portion 44 of the surface property reformation sheet 40 are transferred to the surface of the above-described protective layer.

For example, as shown in FIGS. 4A to 4D, in the case where the treatment is conducted through the use of the surface property reforming sheet 40 having a surface formed into a smooth mirror-finished surface, the surface glossiness of the image print (protective layer) can be enhanced.

Figure 4A:
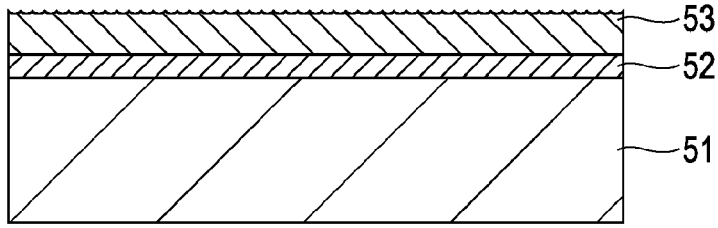
FIGS. 4A to 4D are sectional views of a treatment process concept showing a treatment method for forming a high gloss surface on the basis of a surface property reforming sheet.

For example, as shown in FIG. 4A, the ink layer (refer to FIGS. 2A and 2B) of the ink ribbon is transferred to the recording sheet 51 so as to form an image formation layer 52. Furthermore, the protective material layer (refer to FIGS. 2A and 2B) of the ink ribbon is transferred so as to form a protective layer 53.

As is described with reference to FIG. 1, the surface property reforming sheet 40 is disposed in such a way as to be able to move interposing between the recording sheet 51 and the ink ribbon 30.

For example, in the case where the surface of the image print after the image printing (image formation) and the treatment for forming the protective layer is made into a high gloss surface, initially, the image print subjected to the treatment for forming the protective layer is aligned with the surface property reforming portion 43 (mirror-finished surface) of the surface property reformation sheet 40 by driving the rollers of the two.

At this time, the ink ribbon 30 has no role in the surface property reforming treatment and, therefore, is aligned with a used part of the protective material layer used just before the surface property reforming treatment. Consequently, the time used for feeding (rewinding) the ink ribbon 30 is minimized, and setting can be completed speedily. Moreover, since the above-described protective material layer is wholly transferred to the recording sheet 51, the used part thereof is in the state of being consumed uniformly, and an advantage is provided from this point of view as well.

Figure 4B:
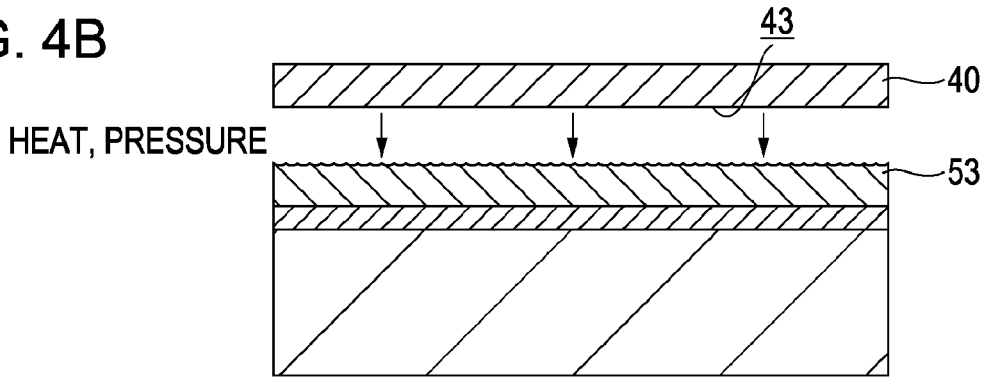

When the alignment of the recording sheet 51, the surface property reforming sheet 40, and the ink ribbon 30 is completed as described above, a pressure is applied to the surface property reforming sheet 40 on the above-described protective layer 53 while heating is conducted, as shown in FIG. 4B.

In this regard, in a manner similar to that in common image printing, the surface property reforming treatment is conducted while a pressure is applied with the thermal head 11 and the platen roller 12, heating is conducted in such a way that the temperature of the protective layer 53 of the recording sheet 51 becomes about 70° C. to 120° C., and they (the recording sheet 51, the surface property reforming sheet 40, and the ink ribbon 30) are moved simultaneously.

Figure 4C:
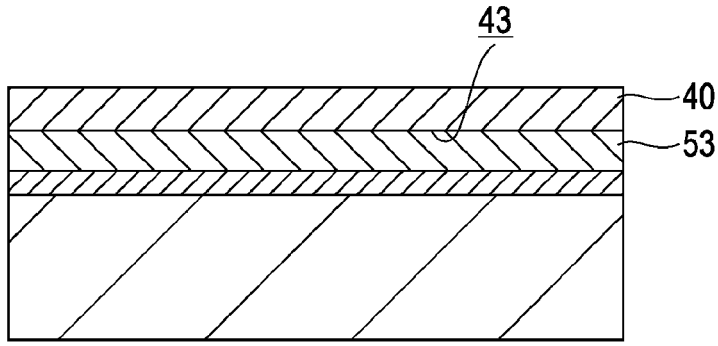

As a result, the temperature of the above-described protective layer 53 on the image print surface becomes in the vicinity of the glass transition temperature and, thereby, the protective layer 53 comes into the state of being softened to some extent and adhered to the surface property reforming portion 43, as shown in FIG. 4C. Consequently, the surface state of the above-described protective layer 53 is reformed in such a way as to have the surface properties (here, high gloss surface) following the surface state of the contact surface of the surface property reforming portion 43.

Figure 4D:
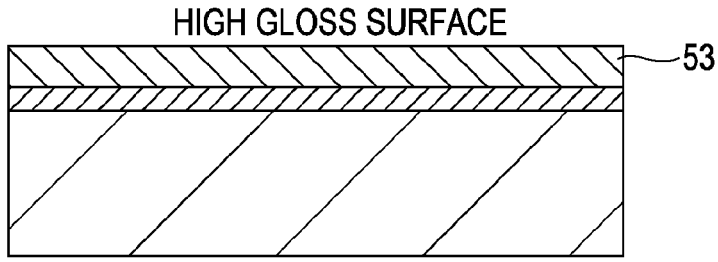

Subsequently, with decreasing proximity of the portion subjected to the surface property reforming treatment to the heating portion of the thermal head, the temperature of the portion subjected to the surface property reforming treatment becomes lower than the temperature of the above-described surface property reforming treatment, and the surface property reforming sheet 40 is sequentially peeled off the protective layer 53. As a result, the surface of the protective layer 53 becomes a glossy surface (hereafter referred to as a high gloss surface) equal to the surface of a silver halide photograph, as shown in FIG. 4D.

Furthermore, for example, as shown in FIGS. 5A to 5D, in the case where the treatment is conducted through the use of the surface property reforming sheet 40 with a surface having an uneven shape corresponding to desired matte finish, the surface of the image print (protective layer) can be formed into the matte finish.

Figure 5A:
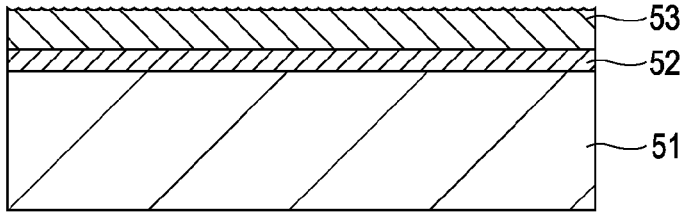
FIGS. 5A to 5D are sectional views of a treatment process concept showing a treatment method for forming a matte finish surface on the basis of a surface property reforming sheet.

For example, as shown in FIG. 5A, the ink layer (refer to FIGS. 2A and 2B) of the ink ribbon is transferred to the recording sheet 51 so as to form an image formation layer 52. Furthermore, the protective material layer (refer to FIGS. 2A and 2B) of the ink ribbon is transferred so as to form a protective layer 53.

As is described with reference to FIG. 1, the surface property reforming sheet 40 is disposed in such a way as to be able to move interposing between the recording sheet 51 and the ink ribbon 30.

For example, in the case where the surface of the image print after the image printing (image formation) and the treatment for forming the protective layer is made into a matte finish surface, initially, the image print subjected to the treatment for forming the protective layer is aligned with the surface property reforming portion 44 (matte finish surface) of the surface property reformation sheet 40 by driving the rollers of the two.

At this time, the ink ribbon 30 has no role in the surface property reforming treatment and, therefore, is aligned with a used part of the protective material layer used just before the surface property reforming treatment. Consequently, the time used for feeding (rewinding) the ink ribbon 30 is minimized, and setting can be completed speedily. Moreover, since the above-described protective material layer is wholly transferred to the recording sheet 51, the used part thereof is in the state of being consumed uniformly, and an advantage is provided from this point of view as well.

Figure 5B:
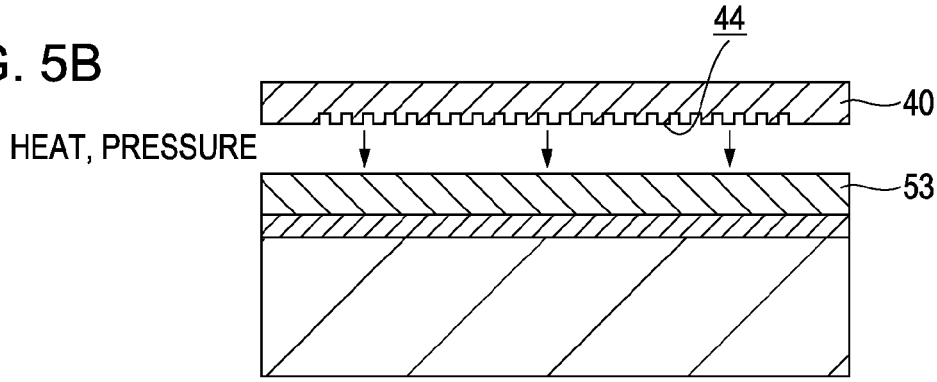

When the alignment of the recording sheet 51, the surface property reforming sheet 40, and the ink ribbon 30 is completed as described above, a pressure is applied to the surface property reforming sheet 40 on the above-described protective layer 53 while heating is conducted, as shown in FIG. 5B.

In this regard, in a manner similar to that in common image printing, the surface property reforming treatment is conducted while a pressure is applied with the thermal head 11 and the platen roller 12, heating is conducted in such a way that the temperature of the protective layer 53 of the recording sheet 51 becomes about 70° C. to 120° C., and they (the recording sheet 51, the surface property reforming sheet 40, and the ink ribbon 30) are moved simultaneously.

Figure 5C:
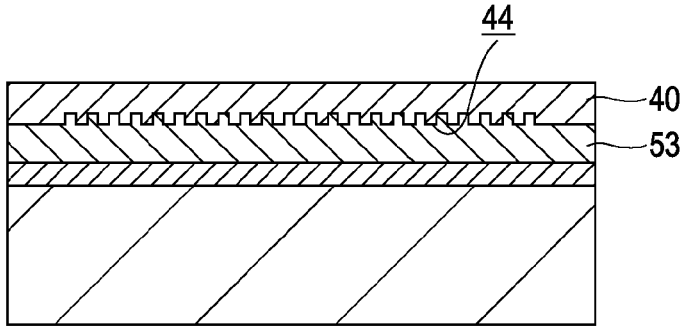
Figure 5D:
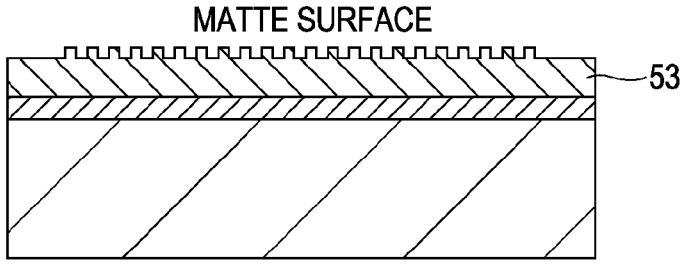
Figure 6:
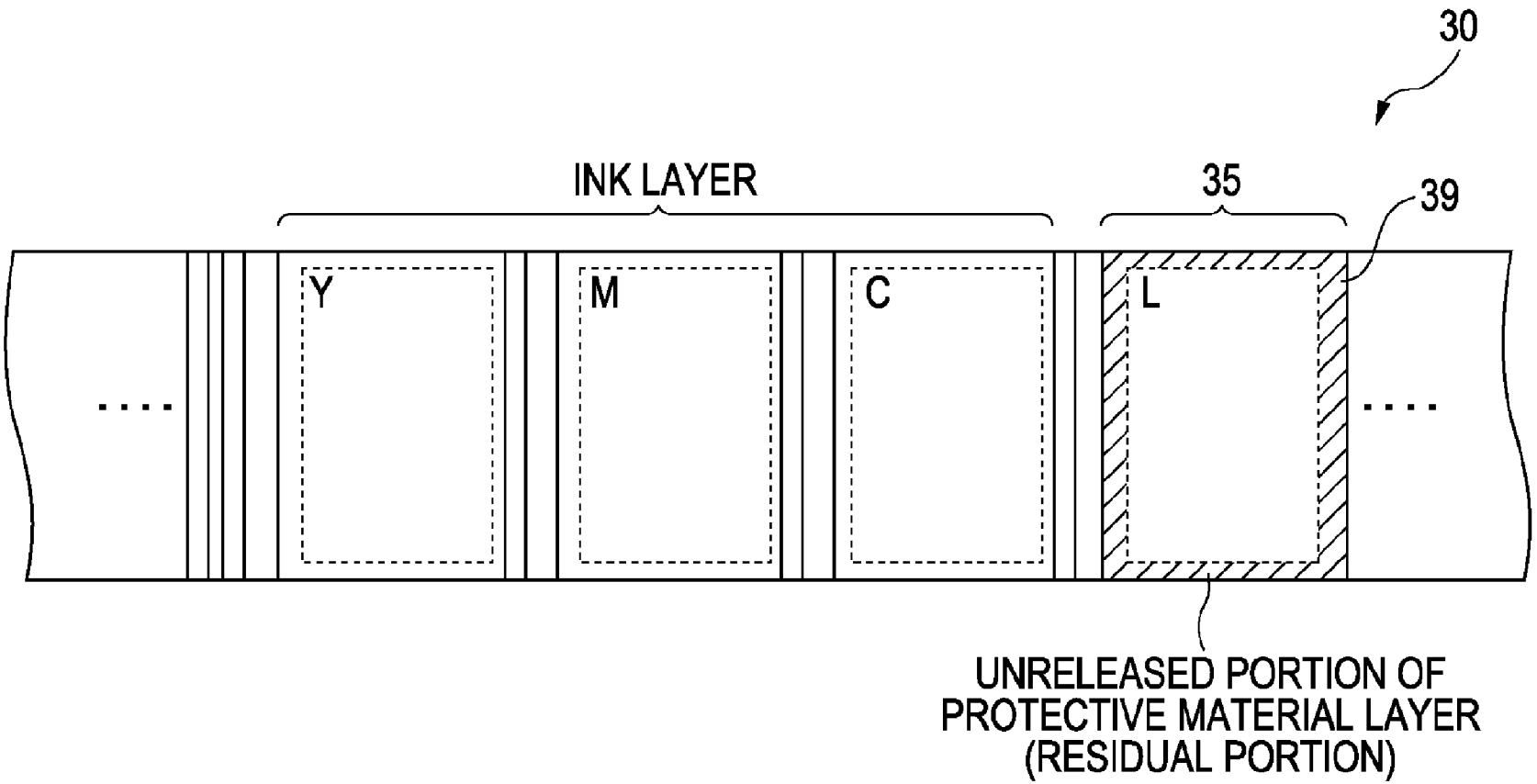
FIG. 6 is a plan view showing an unreleased portion of a protective material layer on an ink ribbon according to related art.

As a result, the temperature of the above-described protective layer 53 on the image print surface becomes in the vicinity of the glass transition temperature and, thereby, the protective layer 53 comes into the state of being softened to some extent and adhered to the surface property reforming portion 44, as shown in FIG. 5C. Consequently, the surface state of the above-described protective layer 53 is reformed in such a way as to have the surface properties (here, matte finish surface) following the surface state of the contact surface of the surface property reforming portion 44.

Therefore, according to the above-described individual image forming methods, not only the above-described enhancement of the surface glossiness, but also provision of a desired surface properties to the image print (protective layer) can be conducted. If a plurality of types of surface properties of the surface property reforming sheet 40 are prepared and can be selected, it is easy to change in accordance with preferences of the user. For example, as described with reference to FIGS. 3A and 3B, it is favorable that the surface property reforming portion 43 for obtaining a high gloss surface and the surface property reforming portion 44 for obtaining a matte finish surface are formed side by side on the base material sheet 41 in a longitudinal direction of the base material sheet 41.

In the above description, for the sake of convenience, the explanation has been made with reference to the case of merely two surface property reforming portions 43 and 44. However, the numbers of types and arrays are not limited to two, and a desired number, e.g., three or more, of arrays can be employed.

Furthermore, regarding the type of the plurality of arrays of surface property reforming portions, three types or more of different surface property reforming portions can be disposed. The breakdown of the plurality of surface property reforming portions is not specifically limited and may be changed in accordance with the frequencies of use and the like of desired types of surface property reforming treatment. A plurality of surface property reforming portions of the same type may be arrayed successively.

In the above-described individual surface property reforming treatments, a non-adhesion treatment layer 45 is formed on a surface of the surface property reforming sheet 40 on the ink ribbon 30 side. Since this non-adhesion treatment layer 45 is included, when the pressure and heat are applied to the surface property reforming sheet 40 together with the ink ribbon 30 in the stage of the above-described surface property reforming treatment, it does not occur that the surface property reforming sheet 40 and the ink ribbon 30 are adhered and peeling becomes difficult.

Moreover, transfer of the ink layer 33 or the protective material layer 35 formed on the ink ribbon 30 to the surface property reforming sheet 40 side is prevented. That is, even when the unreleased portion of the protective material layer, which has been described with reference to related art, is subjected to the pressure and heat treatment, adhesion to the backside of the surface property reforming sheet 40 can be prevented.

The above-described non-adhesion treatment layer 45 is formed from a releasable resin. For example, the above-described releasable resin is formed from at least a fluororesin including a structure represented by Chemical formula 1 or Chemical formula 2 as a part of the structure or a layer containing the fluororesin as a primary component.

Chemical formula 1

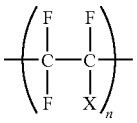

X represents F or Cl

-continued

Chemical formula 2

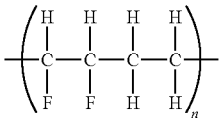

Specifically, the above-described non-adhesion treatment layer can be formed by, for example, coating the surface property reforming sheet with a fluororesin containing at least one of polytetrafluoroethylenes (PTFE), tetrafluoroethylene-perfluoroalkyl vinyl ether copolymers (PFA), fluorinated ethylene propylene copolymers (FEP), e.g., tetrafluoroethylene-hexafluoropropylene copolymers, tetrafluoroethylene-ethylene copolymers (ETFE), ethylene-chlorotrifluoroethylene copolymers (PECTFE), and polyvinylidene fluorides (PVdF), a fluororesin formed from a copolymer including a basic structure of the above-described fluororesins, or a coating material including a mixture containing the above-described fluororesin as a primary component and conducting a heat treatment.

Regarding the coating with these fluororesins, in order to improve the adhesion between the fluororesin layer and the surface property reforming sheet, a primer layer may be disposed between the surface property reforming sheet and the fluororesin layer appropriately.

An example of a method for forming the non-adhesion treatment layer 45 will be described below.

A primer layer is formed on the backside of the surface property reforming sheet 40 while a front surface side (surface on the side in contact with the surface of the protective layer 53 of photographic paper in the surface property reforming treatment) of a surface property reforming sheet, which is formed from a polyimide film, e.g., UPILEX, and which is degreased and cleaned in advance, is masked in order to avoid undergoing the surface property reforming treatment. Regarding the formation of the primer layer, for example, a water-soluble primer coat material is applied by an air-spraying method and, thereafter, drying is conducted at a temperature of about 100° C. to 280° C. for a few minutes to a few tens of minutes, so as to form a primer layer having a thickness of about 5 to 15 μm.

Subsequently, a water-soluble coat material in which, for example, an FEP resin is dispersed is applied as a top layer of the primer layer (top coat layer) by the air-spraying method, and firing is conducted at a temperature of about 200° C. to 300° C. for 10 minutes to 30 minutes, so as to form a non-adhesion treatment layer having a total film thickness of about 15 to 40 μm including the thickness of the primer layer.

Alternatively, the above-described non-adhesion treatment layer 45 is formed from a modified fluorine based coating material containing at least the above-described fluororesin and an organic binder resin.

Regarding another example of non-adhesion treatment of the surface property reforming sheet, modified type one-coat coating materials containing various organic binder resins, e.g., epoxy resins and polyimide resins, together with the above-described fluororesin can be used. For example, various modified type coating materials, e.g., "Teflon S series" (trade name) produced by DuPont and "Tough Coat Enamel" series produced by Daikin Industries, Ltd., can be used.

In the case where these modified types are used, a double-layer structure is formed, in which an organic binder resin generates strong adhesion to a surface property reforming sheet serving as a base material through firing and a surface of the coating film exhibits characteristics of a fluororesin. These coating materials exhibit excellent adhesion and abrasion resistance on the basis of combination of the organic binder resin and the fluororesin. In the case where this type of coating material is used, the primer layer is unnecessary, a coating film can be formed by one coat, and a paint film having few pinholes is obtained. Therefore, the non-adhesion treatment layer can be made thin. Consequently, it is possible to favorably use for transferring the heat due to thermal head to a laminating layer on the surface of the recording sheet efficiently.

In this case, in a manner similar to that in the above-described case, a front surface side (surface on the side in contact with the surface of the protective layer of photographic paper in the surface property reforming treatment) of a surface property reforming sheet, which is formed from, for example, UPILEX and which is degreased and cleaned in advance, is masked in order to avoid undergoing the surface property reforming treatment. These coating materials are applied directly by the air-spraying method or the like while the mask is applied without coating with a primer. Thereafter, firing is conducted at a temperature of about 150° C. to 300° C. for 10 minutes to 60 minutes, so as to form a non-adhesion treatment layer 45 having a film thickness of about 10 to 40 μm.

The above-described non-adhesion treatment layer 45 is formed from a material containing polyimide siloxane as at least a part of the structure thereof or a layer containing polyimide siloxane as a primary component.

Regarding another example of non-adhesion treatment of the surface property reforming sheet, a material containing polyimide siloxane as a primary component can be used. For example, heat-resistant adhesive materials "UPA83 series" (trade name) produced by UBE INDUSTRIES, LTD., can be used as these materials. A coating having a predetermined thickness is applied to the backside of the surface property reforming sheet 40 by using a common coater in related art or the like and, thereafter, predrying at about 90° C. and curing at a temperature of about 100° C. to 180° C. for 10 minutes to 60 minutes are conducted. In this manner, the non-adhesion treatment layer 45 having a film thickness of about 1 μm to 20 μm is formed.

In the case where the non-adhesion treatment layer 45 is formed by using these materials containing polyimide siloxane as a primary component, good adhesion can be obtained when the above-described polyimide film is adopted as a material for the surface property reforming sheet 40. Furthermore, good releasability can be obtained because of siloxane modification.

The above-described material is soluble in a solvent and coating can be conducted in a solution state, the film thickness can be controlled easily, defects, e.g., pinholes, are reduced, and a thin film can be produced. Therefore, the thickness of the non-adhesion treatment layer 45 can be decreased as compared with that in the above-described example in which the fluororesin based material is used. Consequently, it is possible to favorably use for transferring the heat due to the thermal head 11 to the protective layer 53 on a surface of the recording sheet 51 efficiently in the surface property reforming treatment.

Moreover, since the siloxane unit is introduced into a part of the molecular structure of the resin, the flexibility is exhibited. Therefore, even in the case where take-up and the like of surface property reforming sheet are repeated, cracking and the like do not occur easily, and it is possible to use as a non-adhesion treatment layer which is stable for a long time.

The above-described non-adhesion treatment layer 45 is formed from, for example, a solvent-soluble fluorine based coating material.

Regarding another example of materials used for the non-adhesion treatment of the surface property reforming sheet, various solvent-soluble fluorine based coating materials can be used. Examples of these fluorine based coating materials include various fluoroalkyl silane coating materials, e.g., "XC98-B2472" (trade name: produced by Toshiba Silicones). Examples of fluorine silicone based coating materials include "KP-801M" (trade name: produced by Shin-Etsu Chemical Co., Ltd.). Furthermore, solvent-soluble fluorine based coating materials, e.g., "CYTOP" (trade name: produced by ASAHI GLASS CO., LTD.), may be used.

In the case where the non-adhesion treatment layer is formed by using these coating materials, in an example of forming methods, a predetermined thickness of coating is provided on the backside of the surface property reforming sheet by using a method in related art. Regarding the coating method, various coating apparatuses, e.g., roll coaters, meniscus coaters, and gravure coaters, other common coating apparatuses, and various coating apparatuses of spray type and brush coating can be used.

Thereafter, predrying is conducted at about 90° C. for a few minutes to a few tens of minutes. Subsequently, curing is conducted at a temperature of about 90° C. to 180° C. for 10 minutes to 30 minutes so as to form the non-adhesion treatment layer having a film thickness of about 0.1 μm to 10 μm.

In the case where these fluorine based coating materials, e.g., fluoroalkyl silane and "CYTOP", are used, the film thickness can be made very small by an adjustment of the solvent dilution condition, an adjustment of coating condition, and the like. Since these materials are transparent in a visible light region, an inspection in production of the surface property reforming sheet 40, image printing in the image forming apparatus 1, and detection of position of the surface property reforming portions 43 and 44 for the surface property reforming treatment can be conducted smoothly by taking advantage of the feature. Therefore, excellent effects are exhibited in the function and the production.

Since the thickness of the non-adhesion treatment layer 45 can be made very small, it is possible to favorably use for transferring the heat due to the thermal head to the protective layer 53 on a surface of the recording sheet 51 efficiently in the surface property reforming treatment.

Furthermore, the above-described non-adhesion treatment layer 45 is formed through a plasma treatment by using a fluorine based gas or sputtering by using a non-adhesive fluororesin as a target.

For example, it is possible to employ at least a method in which a carbon fluoride based gas is used and a carbon fluoride film is formed through plasma polymerization.

It is also possible to form a thin film of the non-adhesion treatment layer 45 through sputtering in which a target of a fluororesin, e.g., PTFE, is used and an argon gas is used. Consequently, it is possible to favorably use for transferring the heat due to the thermal head to the protective layer 53 on a surface of the recording sheet 51 efficiently in the surface property reforming treatment.

Moreover, a very thin non-adhesion treatment layer 45 can be formed easily by these methods. It is also possible to conduct continuous film formation in the form of a rolled film easily in the production process of the surface property reforming sheet 40.

The above-described non-adhesion treatment layer 45 may be a porous film. For example, a porous silica film is included. This porous silica film is, for example, a copolymer of alkoxysilanes and fluorine-containing alkoxysilanes. For example, the porous silica film is a copolymer of tetraalkoxysilanes and fluorine-containing trialkoxysilanes.

The fluorine-containing trialkoxysilanes are represented by, for example, a general formula $(ZO)_3SiR$.

The above-described Z represents a methyl group, an ethyl group, a n-propyl group, an i-propyl group, a n-butyl group, a t-butyl group, an i-butyl group, or a sec-butyl group.

The above-described R represents a fluorine atom or $(CH_2)_a(CF_2)_b(O(CF_2)_c)_dX$.

The above-described X represents a fluorine atom, $OCF_3$, $OCF(CF_3)_2$, $OC(CF_3)_3$, an alkyl group, or a phenyl group. In the formula, a=0 to 3, b=0 to 3, c=1 to 3, and d=0 to 3.

Alternatively, it is a compound represented by $C_6HeF_{(5-e)}$. In the formula, e=0 to 4.

Alternatively, a porous hydrogen silsesquioxane film (porous HSQ film) and a porous methylsilsesquioxane film (porous MSQ film) can be used.

As described above, an occurrence of defect peeling after the surface property reforming treatment due to adhesion between the surface property reforming sheet 40 and the ink ribbon 30 can be prevented by forming the non-adhesion treatment layer 45 on a surface of the surface property reforming sheet 40 on the side to come into contact with the thermal transfer sheet (ink ribbon) 30. In addition, it is possible to prevent accumulation of unreleased portion adhered to the surface property reforming sheet 40 side. Consequently, nonconformity in glossiness and insufficient durability in repetition of the treatment resulting from them can be eliminated.

The present application contains subject matter related to that disclosed in Japanese Priority Patent Application JP 1008-102037 filed in the Japan Patent Office on Apr. 10, 2008, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An image forming system comprising:

(a) feeding means for feeding a recording medium in a predetermined direction;

(b) a thermal transfer sheet having (i) an ink layer to form an image through thermal transfer on a surface of the recording medium and (ii) a protective material layer to form a protective layer protecting the image through thermal transfer;

(c) a thermal transfer sheet transporting means for transporting the thermal transfer sheet;

(d) a surface property reforming sheet having (i) an image printing opening disposed in such a way that the thermal transfer sheet comes into direct contact with a surface of the recording medium and (ii) a surface property reforming portion to reform the surface state of the protective layer protecting the image formed on the recording medium;

(e) a reforming sheet moving means for moving the surface property reforming sheet; and (f) a thermal head to thermally transfer the ink layer or the protective material layer of the thermal transfer sheet to a surface of the recording medium, wherein, a non-adhesion treatment layer is formed on at least a surface of the surface property reforming sheet on the side to come into contact with the thermal transfer sheet.

2. The image forming system according to claim 1, wherein the non-adhesion treatment layer is formed from a releasable resin.

3. The image forming system according to claim 1, wherein the non-adhesion treatment layer is formed from a porous film.

4. An image forming system comprising:

(a) feeding means for feeding a recording medium to be recorded in a predetermined direction;

(b) a thermal transfer sheet having (i) an ink layer to form an image through thermal transfer on a surface of the recording medium to be recorded and (ii) a protective material layer to form a protective layer protecting the image through thermal transfer;

(c) a thermal transfer sheet transporting means for transporting the thermal transfer sheet;

(d) a surface property reforming sheet having (i) an image printing opening disposed in such a way that the thermal transfer sheet comes into direct contact with a surface of the recording medium to be recorded and (ii) a surface property reforming portion to reform the surface state of the protective layer protecting the image formed on the recording medium to be recorded;

(e) a reforming sheet moving means for moving the surface property reforming sheet; and (f) a thermal head to thermally transfer the ink layer or the protective material layer of the thermal transfer sheet to a surface of the recording medium to be recorded, wherein, a non-adhesion treatment layer is formed on at least a surface of the surface property reforming sheet on the side to come into contact with the thermal transfer sheet, the non-adhesion treatment layer is formed from a fluororesin including a structure represented by Chemical formula 3 or Chemical formula 4 as a part of the structure thereof or a layer containing the fluororesin as a primary component, and Chemical formulae 3 and 4 are:

Chemical formula 3

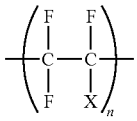

X represents F or Cl

Chemical formula 4

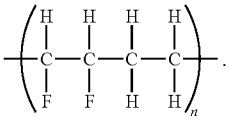

5. The image forming system according to claim 4, wherein the non-adhesion treatment layer is formed from a modified fluorine based coating material containing at least the fluororesin and an organic binder resin.

6. An image forming system comprising:

(a) feeding means for feeding a recording medium to be recorded in a predetermined direction;

(b) a thermal transfer sheet having (i) an ink layer to form an image through thermal transfer on a surface of the recording medium to be recorded and (ii) a protective material layer to form a protective layer protecting the image through thermal transfer;

(c) a thermal transfer sheet transporting means for transporting the thermal transfer sheet;

(d) a surface property reforming sheet having (i) an image printing opening disposed in such a way that the thermal transfer sheet comes into direct contact with a surface of the recording medium to be recorded and (ii) a surface property reforming portion to reform the surface state of the protective layer protecting the image formed on the recording medium to be recorded;

(e) a reforming sheet moving means for moving the surface property reforming sheet; and (f) a thermal head to thermally transfer the ink layer or the protective material layer of the thermal transfer sheet to a surface of the recording medium to be recorded, wherein, a non-adhesion treatment layer is formed on at least a surface of the surface property reforming sheet on the side to come into contact with the thermal transfer sheet, and the non-adhesion treatment layer is formed from a fluororesin containing at least one of tetrafluoroethylene, tetrafluoroethylene-perfluoroalkyl vinyl ether copolymers, tetrafluoroethylene-hexafluoropropylene copolymers, tetrafluoroethylene-ethylene copolymers, ethylene-chlorotrifluoroethylene copolymers, and polyvinylidene fluorides, a fluororesin containing a copolymer including a basic structure of the fluororesins, or a material containing the fluororesin as a primary component.

7. An image forming system comprising:

(a) feeding means for feeding a recording medium to be recorded in a predetermined direction;

(b) a thermal transfer sheet having (i) an ink layer to form an image through thermal transfer on a surface of the recording medium to be recorded and (ii) a protective material layer to form a protective layer protecting the image through thermal transfer;

(c) a thermal transfer sheet transporting means for transporting the thermal transfer sheet;

(d) a surface property reforming sheet having (i) an image printing opening disposed in such a way that the thermal transfer sheet comes into direct contact with a surface of the recording medium to be recorded and (ii) a surface property reforming portion to reform the surface state of the protective layer protecting the image formed on the recording medium to be recorded;

(e) a reforming sheet moving means for moving the surface property reforming sheet; and (f) a thermal head to thermally transfer the ink layer or the protective material layer of the thermal transfer sheet to a surface of the recording medium to be recorded, wherein, a non-adhesion treatment layer is formed on at least a surface of the surface property reforming sheet on the side to come into contact with the thermal transfer sheet, and the non-adhesion treatment layer is formed from a material containing polyimide siloxane as at least a part of the structure thereof or a layer containing polyimide siloxane as a primary component.

8. An image forming system comprising:

(a) feeding means for feeding a recording medium to be recorded in a predetermined direction;

(b) a thermal transfer sheet having (i) an ink layer to form an image through thermal transfer on a surface of the recording medium to be recorded and (ii) a protective material layer to form a protective layer protecting the image through thermal transfer;

(c) a thermal transfer sheet transporting means for transporting the thermal transfer sheet;

(d) a surface property reforming sheet having (i) an image printing opening disposed in such a way that the thermal transfer sheet comes into direct contact with a surface of the recording medium to be recorded and (ii) a surface property reforming portion to reform the surface state of the protective layer protecting the image formed on the recording medium to be recorded;

(e) a reforming sheet moving means for moving the surface property reforming sheet; and (f) a thermal head to thermally transfer the ink layer or the protective material layer of the thermal transfer sheet to a surface of the recording medium to be recorded, wherein, a non-adhesion treatment layer is formed on at least a surface of the surface property reforming sheet on the side to come into contact with the thermal transfer sheet, and the non-adhesion treatment layer is formed from a solvent-soluble fluorine based coating material.

9. An image forming system comprising:

(a) feeding means for feeding a recording medium to be recorded in a predetermined direction;

(b) a thermal transfer sheet having (i) an ink layer to form an image through thermal transfer on a surface of the recording medium to be recorded and (ii) a protective material layer to form a protective layer protecting the image through thermal transfer;

(c) a thermal transfer sheet transporting means for transporting the thermal transfer sheet;

(d) a surface property reforming sheet having (i) an image printing opening disposed in such a way that the thermal transfer sheet comes into direct contact with a surface of the recording medium to be recorded and (ii) a surface property reforming portion to reform the surface state of the protective layer protecting the image formed on the recording medium to be recorded;

(e) a reforming sheet moving means for moving the surface property reforming sheet; and (f) a thermal head to thermally transfer the ink layer or the protective material layer of the thermal transfer sheet to a surface of the recording medium to be recorded, wherein, a non-adhesion treatment layer is formed on at least a surface of the surface property reforming sheet on the side to come into contact with the thermal transfer sheet, and the non-adhesion treatment layer is formed through a plasma treatment by using a fluorine based gas or sputtering by using a non-adhesive fluororesin as a target.

10. A surface property reforming sheet comprising:

an image printing opening to allow a thermal transfer sheet to come into direct contact with a surface of a recording medium, the thermal transfer sheet forming an image through thermal transfer on the surface of the recording medium and a protective layer protecting the image; and a surface property reforming portion to reform the surface of the protective layer protecting the image formed on the recording medium, wherein, a non-adhesion treatment layer is formed on at least a surface on the side to come into contact with the thermal transfer sheet.

11. A method for forming an image, comprising the steps of:

(a) sandwiching a surface property reforming sheet between a recording medium and a thermal transfer sheet, the surface property reforming sheet having (i) an image printing opening disposed in such a way that the thermal transfer sheet comes into direct contact with a surface of the recording medium and (ii) a surface property reforming portion to reform the surface state of a protective layer protecting an image formed on the recording medium, the thermal transfer sheet having (i) an ink layer to form an image through thermal transfer on a surface of the recording medium and (ii) a protective material layer to form a protective layer protecting the image through thermal transfer;

(b) transporting the recording medium, the surface property reforming sheet, and the thermal transfer sheet in a predetermined direction;

(c) forming the image by thermally transferring the ink layer to the recording medium while the ink layer of the thermal transfer sheet and an image formation position of the recording medium are aligned with the image printing opening;

(e) forming the protective layer by thermally transferring the protective material layer to the recording medium while the protective material layer of the thermal transfer sheet and the position of the image formed on the recording medium are aligned with the image printing opening; and (f) reforming the surface of the protective layer while the surface property reforming portion is pressed against the protective layer from the thermal transfer sheet side and heating is conducted, wherein, a non-adhesion treatment layer is formed on at least a surface of the surface property reforming sheet on the side to come into contact with the thermal transfer sheet.

12. The method for forming an image according to claim 11, wherein a region on the thermal transfer sheet when the surface of the protective layer is reformed is specified to be a region of the protective material layer after being subjected to the transfer.

13. An image forming system comprising:

(a) a feeding device feeding a recording medium in a predetermined direction;

(b) a thermal transfer sheet having (i) an ink layer to form an image through thermal transfer on a surface of the recording medium and (ii) a protective material layer to form a protective layer protecting the image through thermal transfer;

(c) a thermal transfer sheet transporting device transporting the thermal transfer sheet;

(d) a surface property reforming sheet having (i) an image printing opening disposed in such a way that the thermal transfer sheet comes into direct contact with a surface of the recording medium and (ii) a surface property reforming portion to reform the surface state of the protective layer protecting the image formed on the recording medium;

(e) a reforming sheet moving device moving the surface property reforming sheet; and (f) a thermal head to thermally transfer the ink layer or the protective material layer of the thermal transfer sheet to a surface of the recording medium, wherein, a non-adhesion treatment layer is formed on at least a surface of the surface property reforming sheet on the side to come into contact with the thermal transfer sheet.

* * * * *